US009593525B1

(12) United States Patent
Morris et al.

(10) Patent No.: US 9,593,525 B1
(45) Date of Patent: Mar. 14, 2017

(54) ARTICULATED OVERHEAD DOOR SYSTEMS AND METHODS

(71) Applicants: Richard P. Morris, Oakville (CA); Kenneth H. Betts, St. Thomas (CA); Howard J. Williams, Muncy, PA (US)

(72) Inventors: Richard P. Morris, Oakville (CA); Kenneth H. Betts, St. Thomas (CA); Howard J. Williams, Muncy, PA (US)

(73) Assignee: EMEH, Inc., Lebanon, NJ (US)

( * ) Notice: Subject to any disclaimer, the term of this patent is extended or adjusted under 35 U.S.C. 154(b) by 0 days.

(21) Appl. No.: 14/859,923

(22) Filed: Sep. 21, 2015

(51) Int. Cl.
*E06B 3/48* (2006.01)
*E05F 15/605* (2015.01)
*E05F 15/673* (2015.01)

(52) U.S. Cl.
CPC ..... *E06B 3/483* (2013.01); *E05F 15/605* (2015.01); *E05F 15/673* (2015.01); *E06B 3/485* (2013.01)

(58) Field of Classification Search
CPC ..... E05F 15/673; E05F 15/605; E06B 3/483; E06B 3/485; E05D 15/262
USPC ..... 160/207
See application file for complete search history.

(56) References Cited

U.S. PATENT DOCUMENTS 1,254,502 A * 1/1918 Hoppie ..... E05F 15/689 475/153
1,787,589 A * 1/1931 Nies ..... E06B 3/483 16/DIG. 31
1,804,329 A * 5/1931 Farr ..... E06B 3/483 16/96 R
3,155,147 A 11/1964 Smith et al.
4,637,446 A 1/1987 McQueen et al.
6,035,917 A * 3/2000 Cohen-Ravid ..... E06B 9/063 160/207
6,056,037 A * 5/2000 Jonkman, Sr. ..... E05D 15/262 160/118
6,199,617 B1 3/2001 Schweiss
6,659,157 B1 12/2003 Suderman
7,168,477 B2 1/2007 Salice
7,219,711 B2 5/2007 Keller et al.
7,575,037 B2 8/2009 Jorgensen
7,814,957 B2 10/2010 Crown
8,714,229 B2 5/2014 Crown et al.
2010/0287727 A1 11/2010 Suderman

OTHER PUBLICATIONS http://web.hufcor.com/hufcor-hydrau-lift-bifold-doors.

* cited by examiner

*Primary Examiner* — Blair M Johnson

(74) *Attorney, Agent, or Firm* — Clements Bernard Walker PLLC; Lawrence A. Baratta, Jr.; Christopher L. Bernard

(57) ABSTRACT

An articulated door system includes one or more door sections; a lifting block associated with a lower door section of the one or more door sections; a frame supporting the one or more door sections and engaging the lifting block; and a lead screw system including a rotatable lead screw that is configured to engage the lifting block and lift the lower door section up and down based on rotation of the lead screw.

20 Claims, 14 Drawing Sheets

ARTICULATED OVERHEAD DOOR SYSTEMS AND METHODS

FIELD OF THE DISCLOSURE

The present disclosure generally relates to door systems and methods. More particularly, the present disclosure relates to an articulated overhead door systems and methods.

BACKGROUND OF THE DISCLOSURE

Conventional articulated overhead doors operate using devices such as counterweights, springs, lifting straps, and/or hydraulic systems. Disadvantageously, such systems are bulky and not inherently failsafe should a major component fail, such as a chain, cable, or hydraulic line. The key to operation and articulation of these types of doors is the action and forces required to start the door to fold, or articulate, as it starts to lift. Articulation of the door requires that a force be applied perpendicular to the door face, while lifting the door to start the section hinging or folding action. This action can be referred to as "Breaking the elbow." Conventional designs utilize extended arm profiles that extend into the space in order to start this action which distracts from the aesthetic of the door and is prone to damage since they extend into the interior space. This also adds to the required clear space to be maintained in order for the door to operate without interference.

Many articulated door designs utilize heavy counterweights in order to easily operate the door. These counterweights lift up and down with the operation of the door and are most often suspended from cables and guided through the vertical structure of the door frame. The mass or weight of the counter weights are dependent on the weight of the door frame structure and all of the cladding that is mounted onto the operable door frame. Doors systems are typically shipped without cladding and pre balanced from the factory based on the frame weight only. Adding cladding and other components to the door necessitates the recalibration of the mass of the counterweights in order for the door to operate properly. On doors such as this, the counterweights can easily weigh in the hundreds of pounds. With other designs, these counterbalance forces are applied using large coil spring systems instead of counterweights.

BRIEF SUMMARY OF THE DISCLOSURE

In an exemplary embodiment, an articulated door system includes one or more door sections; a lifting block associated with a lower door section of the one or more door sections; a frame supporting the one or more door sections and engaging the lifting block; and a lead screw system including a rotatable lead screw that is configured to engage the lifting block and lift the lower door section up and down based on rotation of the lead screw. The lifting block and the frame utilize a pin system between one another to lift the lower door section responsive to the rotation of the lead screw. The pin system can include a cam slot including an angled slot and associated cam pin engaging the angled slot to start a folding action between the one or more door sections; and a lifting pin engaging a lifting pin slot. The lifting block can include the cam pin and the lifting pin slot, and wherein the frame can include the angled slot and the lifting pin. Responsive to the rotation of the lead screw, the cam pin follows the angled slot and subsequently the lifting pin engages the lifting pin slot. Responsive to the rotation of the lead screw, the lifting pin slot operates precisely with the cam slot and the cam pin such that once the cam pin disengages from the cam slot, the lifting pin has reached the bottom of the lifting pin slot and the lower door section is in a position that the lifting pin lifts the lower door section. Responsive to the rotation of the lead screw, the lifting block moves within an ovular space including the lifting pin slot until the lifting pin hits a bottom of the lifting block thereby engaging the lifting pin to start lifting the lower door section. The lead screw can have a pitch such that if the lead screw drive should fail in any way, the lower door section is held and kept in position. The lead screw system can include a lead screw follower precision machined to match the lead screw and move precisely up or down when the lead screw rotates to move the lifting block. The articulated door system does not utilize springs, strap lifting systems, or counterweights.

In another exemplary embodiment, an articulated door method includes providing one or more door sections; providing a lifting block associated with a lower door section of the one or more door sections; providing a frame supporting the one or more door sections and engaging the lifting block; and providing a lead screw system including a rotatable lead screw that is configured to engage the lifting block and lift the lower door section up and down based on rotation of the lead screw. The lifting block and the frame utilize a pin system between one another to lift the lower door section responsive to the rotation of the lead screw. The pin system can include a cam slot including an angled slot and associated cam pin engaging the angled slot to start a folding action between the one or more door sections; and a lifting pin engaging a lifting pin slot. The lifting block can include the cam pin and the lifting pin slot, and wherein the frame can include the angled slot and the lifting pin. Responsive to the rotation of the lead screw, the cam pin follows the angled slot and subsequently the lifting pin engages the lifting pin slot. Responsive to the rotation of the lead screw, the lifting pin slot operates precisely with the cam slot and the cam pin such that once the cam pin disengages from the cam slot, the lifting pin has reached the bottom of the lifting pin slot and the lower door section is in a position that the lifting pin lifts the lower door section. Responsive to the rotation of the lead screw, the lifting block moves within an ovular space including the lifting pin slot until the lifting pin hits a bottom of the lifting block thereby engaging the lifting pin to start lifting the lower door section. The lead screw can have a pitch such that if the lead screw drive should fail in any way, the lower door section is held and kept in position. The lead screw system can include a lead screw follower precision machined to match the lead screw and move precisely up or down when the lead screw rotates to move the lifting block, and wherein the articulated door system does not utilize springs, strap lifting systems, or counterweights.

In a further exemplary embodiment, a bi-fold articulated door system includes an first door section and a second door section; a lifting block associated with the second door section; a frame supporting the first door section and the second door section and engaging the lifting block; and a lead screw system including a rotatable lead screw that is configured to engage the lifting block and lift the second door section up and down based on rotation of the lead screw.

BRIEF DESCRIPTION OF THE DRAWINGS

The present disclosure is illustrated and described herein with reference to the various drawings, in which like reference numbers are used to denote like system components/method steps, as appropriate, and in which.

DETAILED DESCRIPTION OF THE DISCLOSURE

In various exemplary embodiments, articulated overhead door systems and methods are described. The articulated overhead door systems and methods include a novel drive mechanism supporting the elimination of counterweights and cam action and timing to articulate a door. The drive mechanism utilizes a screw design for a fail-safe design. Additionally, the articulated overhead door systems and methods require no unsightly arm extending into the space to initiate articulation of the door. Note articulation arms also extend into unoccupied space where they may be a hazard and they limit use of adjacent space. Rather, in the systems and methods, articulation is done through the unique design of the lifting block and the cam slot design. Again, the articulated overhead door systems and methods eliminate heavy and difficult to manage and calibrate counterweights and require no stored energy systems such as counterbalances or springs.

Figure 1:
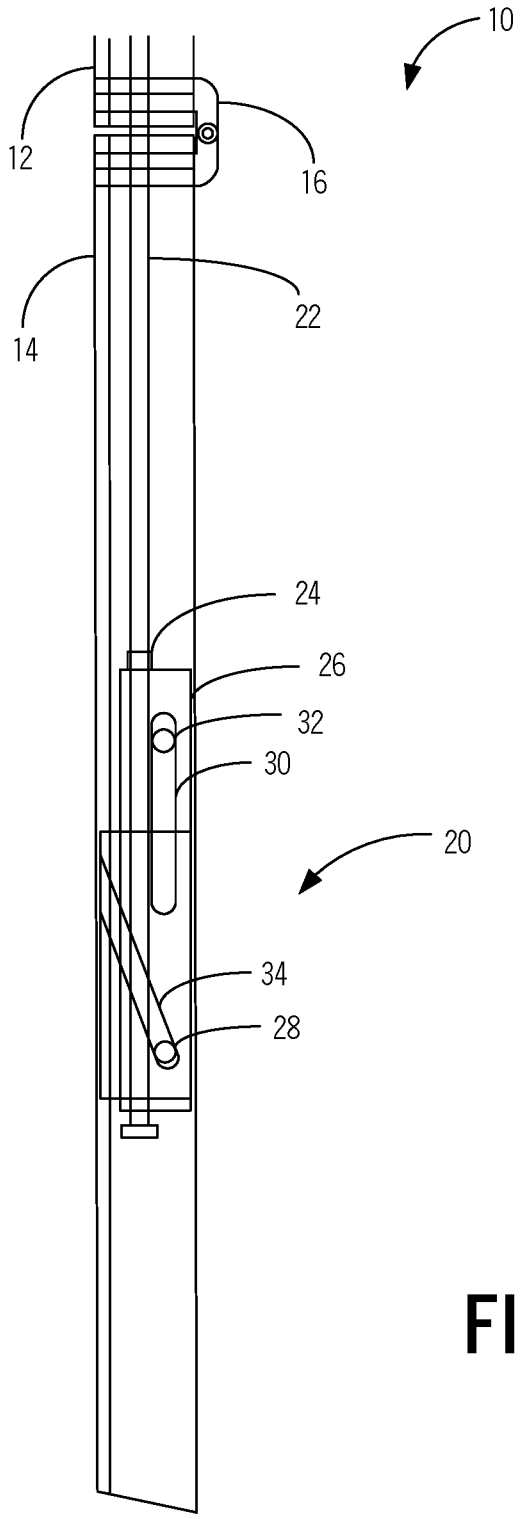
FIG. 1 is a diagram of a side view of an articulated door system with door sections in a closed position.
Figure 2:
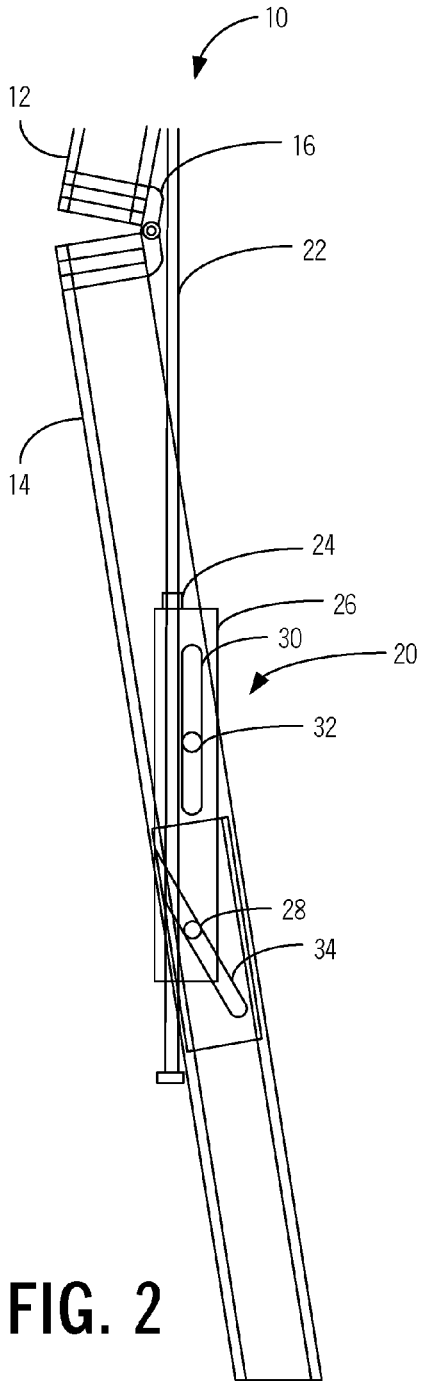
FIG. 2 is a diagram of a side view of the articulated door system with the door sections shown in a first articulated position from FIG. 1.
Figure 3:
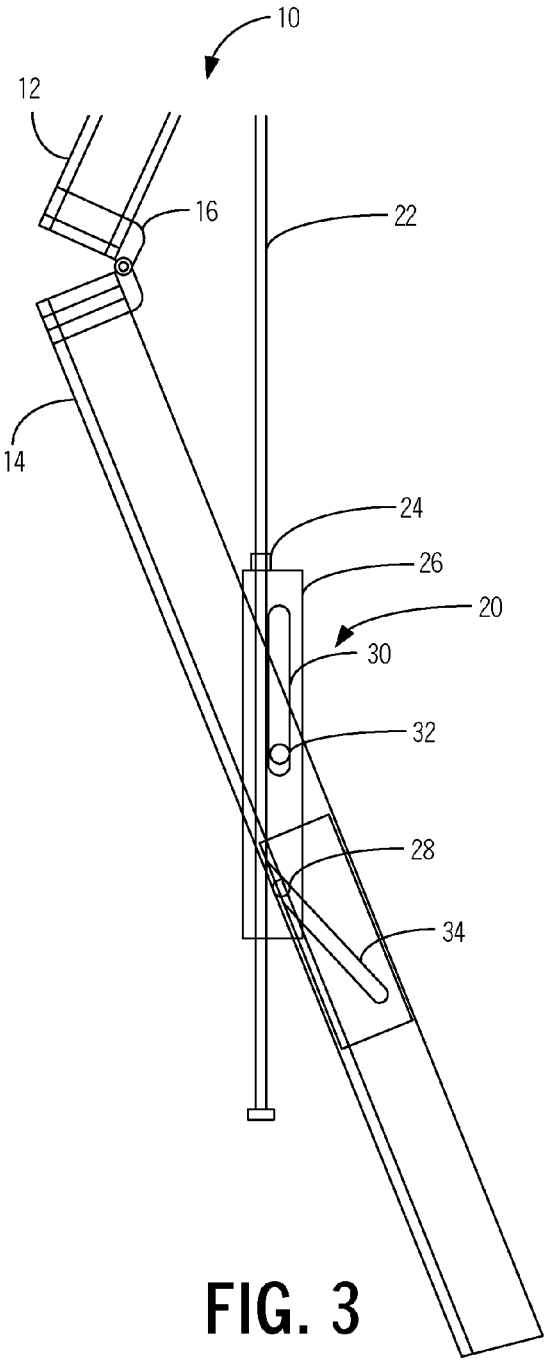
FIG. 3 is a diagram of a side view of the articulated door system with the door sections shown in a second articulated position from FIG. 2.
Figure 4:
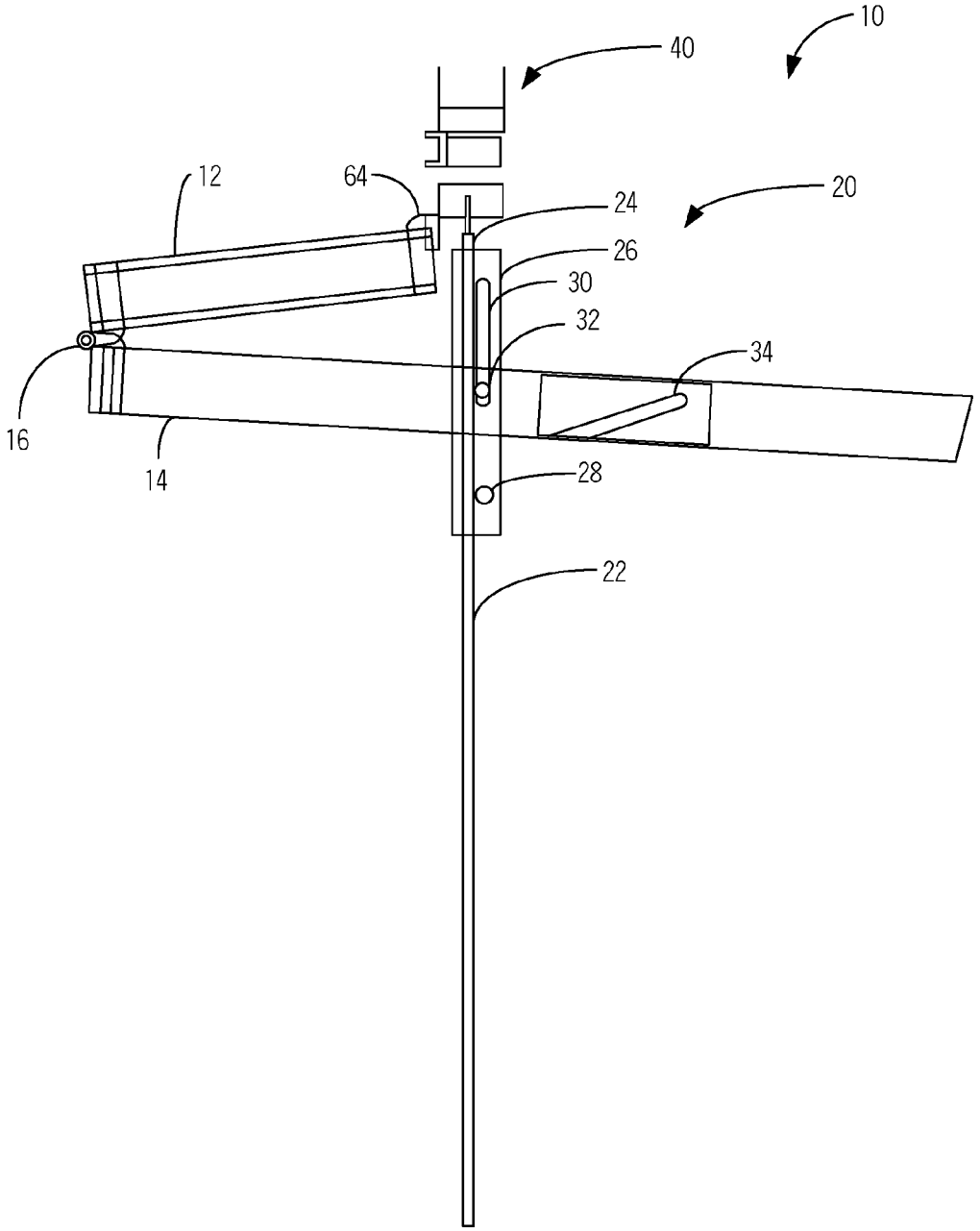
FIG. 4 is a diagram of a side view of the articulated door system with the door sections shown in an open position from FIG. 3.

Referring to FIGS. 1-4, in an exemplary embodiment, various diagrams illustrate an articulated door system 10 with door sections 12, 14 in various stages of articulation. In the various exemplary embodiments described herein, the door sections 12, 14 are shown as two door sections, e.g., bi-fold doors. Those of ordinary skill in the art will recognize the articulated door system 10 could be with one or more door sections. FIG. 1 illustrates the door sections 12, 14 in a closed position, FIGS. 2-3 illustrate articulation of the door sections 12, 14, and FIG. 4 illustrates the door sections 12, 14 in an open position. The door sections 12, 14 are connected to one another by a hinge 16 and are configured to articulate in a door frame 18 via a drive mechanism 20. In an exemplary embodiment, the door frame 18 can include extruded aluminum; although other materials are also contemplated.

The drive mechanism 20 is a lead screw system for lifting and operating the door sections 12, 14. Specifically, the drive mechanism includes a lead screw 22 and a lead screw follower 24 rotatably connected to lead screw 22. The lead screw follower 24 is precision machined to match the lead screw 22 and move precisely up or down when the lead screw 22 turns. The lead screw follower 24 is attached to a lifting block 26 and moves the lifting block 26 up or down depending on the direction of the lead screw 22. By rotating the lead screw 22 clockwise or counter clockwise, the door sections 12, 14 can be made to lift up or down using the lifting block 26 and a pin system. The lifting block 26 has a mating thread system to the lead screw 22 and advances up or down the lead screw 22 as it rotates. The lifting block 26 can be extruded aluminum with heavy duty plastic sliders that allow it to slide easily up and down inside of the door frame 18. The lifting block 26 is attached to the lead screw follower 24 and moves up and down with the lead screw follower 24.

The lead screw 22 is of a certain pitch that, should a screw shaft drive (not shown in FIGS. 1-3) that turns the lead screw 22 become disengaged or separated from the lead screw 22, that the weight of the door sections 12, 14 would be held and kept in position or kept from moving down the lead screw 22 shaft due to the force of gravity. That is, the lead screw 22 has a pitch such that if the lead screw drive should fail in any way, the lower door section 14 is held and kept in position. These screws shaft drives are capable of very high lifting forces and work in both directions. This allows for the elimination of heavy and bulky counterweight spring or strap lifting systems. Also, additional cladding and attachment of items to the door sections 12, 14 do not require recalibration since counterweights are not required. A lead screw type drive system allows for factory calibration and, therefore, no need to reset or calibrate in the field during installation and cladding.

The articulated door system 10 utilizes cam action and timing to articulate the door sections doors 12, 14. This design eliminates the need for arms to extend into space in order to start the folding action or "Breaking of the elbow." This is achieved through the use of an angled slot within the door section 14 and also through a unique timing featured designed into the lifting block 26 that follows the lead screw 22. In other exemplary embodiments, "Breaking of the elbow" can be down through a slave cylinder, which allows the lifting block 26 and the screw 22 to begin lifting the door section 14. In another exemplary embodiment, a hand-operated level can be used to break the elbow, which allows the lifting block 26 and the screw 22 to begin lifting the door section 14.

Note, FIGS. 1-4 are a side view of the articulated door system 10. Those of ordinary skill in the art will recognize the articulated door system 10 can have two sides. The articulated door system 10 can include two lifting blocks 26 and associated equipment, one in each fixed door frame jamb. The lifting block 26 includes a cam pin 28 and a lifting pin slot 30. Each operable door section 14 has a lifting pin 32 protruding from the door section 14. The cam pin 28 in the lifting block 26 follows a cam slot 34 in the door section 14 and the lifting pin 32 engages the lifting pin slot 30 in the lifting block 26. The lifting pin slot 30 is design to work precisely with the cam slot 34 and the cam pin 28. Once the cam pin 28 disengages from the cam slot 34, the lifting pin 32 will have reached the bottom of the lifting pin slot 30 and the door section 14 will be in a position that the lifting pin 32 will now be able to lift the door section 14.

The lifting pin 32 can be fixed in the operable door section 14. The lifting block 26 can move within the ovular space in the lifting block 26 (i.e., the lifting pin slot 30) until it hits the bottom of the lifting block 26. At that point, the lifting block 26 will engage the lifting pin 32 and start lifting it, thereby lifting the door section 14. Note, lifting of the door section 12 (or other door sections) is performed via one or more hinges.

Starting from a totally down position (FIG. 1), the cam pin 28 is at the bottom of the cam slot 34 and the lifting pin 32 is at the top of the lifting pin slot 30 in the lifting block 26. As the lifting block 26 starts to rise, the cam pin 28 pushes against the cam slot 34 and starts to push the bottom of the door section 14 out and thus starts to "Break the elbow." As this is happening, the operable door lifting pin 32 remains stationary due to the lifting pin slot 30 travelling over the lifting pin 32.

In FIG. 2, the cam pin 28 is at a mid position in the cam slot 34 and the lifting pin 32 are at a mid position within the lifting pin slot 30. As the cam pin 28 continues to travel along the cam slot 34, the cam pin 28 continues to push against the cam slot 34 and pushes the bottom of the door section 14 out even further. The cam pin 28 continues to push the bottom of the door section 14 out until it reaches the end of the cam slot 34. At the same instant, the lifting pin 32 rests at the bottom of the lifting pin slot 30 and starts to lift the door section 14, as shown in FIG. 3. This continues until the door sections 12, 14 are in the full up position and the door section 14 is substantially parallel to the floor, as shown in FIG. 4.

Note, the cam pin 28 and the lifting pin 32 apply a force to the door section 14, causing the folding/articulation action between the door sections 12, 14 via the hinge 16. The cam pin 28 is used to start the folding of the hinge 16 and the lifting pin 32 is used to completely raise the door sections 12, 14 after the hinge 16 action is started. Note, the locations of the cam pin 28, the lifting pin slot 30, the lifting pin 32, and the cam slot 34 can be either associated with the lifting block 26 or the door frame 18. For example, the cam pin 28 is illustrated in the door frame 18 and the associated cam slot 34 is on the lifting block 26. The lifting pin 32 is illustrated on the door section 14 (through the lifting block 26) with the associated lifting pin slot 30 on the door frame 18. Alternatively, the lifting pin 32 could be on the door frame 18 and the lifting pin slot 30 on the door section 14 (through the lifting block 26). That is, the systems and methods contemplated various different locations of the various components of the drive mechanism 20.

A down cycle is reverse of above, where the lifting block 26 now travels down the lead screw 22 due to a change in rotation of a screw drive system 40, i.e., a screw shaft drive. At a certain point, and at the same time due to the design of the lifting block 26, the cam pin 28 re-engages the cam slot 34 and the lifting pin 32 becomes unsupported by the lifting block 26.

The lifting block 26 continues down the lead screw 22, and the cam pin 28 continues exerting a horizontal force against the cam slot 34 and pushes the door sections 12, 14 closed. All of this is accomplished by the lead screw 22 travel.

The installation of the articulated door system 10 is designed to be as simple as possible and to minimize labor in the field. All mechanical assembly critical to the operation of the articulated door system 10 is done in a factory, and the components are modularized and are easily connected and installed in the field.

Figure 5:
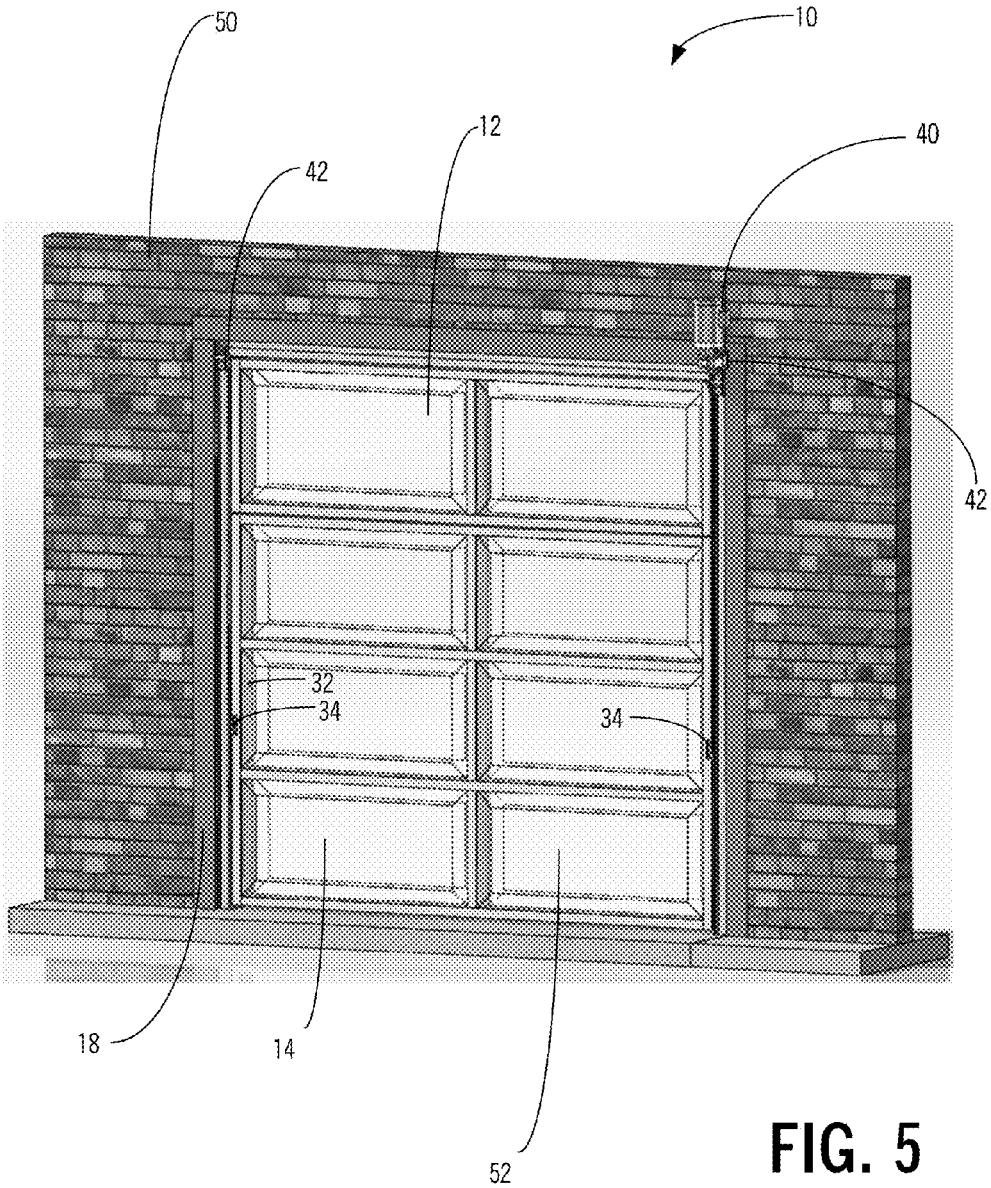
FIG. 5 is a perspective diagram of the articulated door system in a closed position, including an associated wall or other construction supporting the door frame.

Referring to FIGS. 5-10, in various exemplary embodiments, various perspective diagrams illustrate the articulated door system 10. FIG. 5 illustrates the articulated door system 10 in a closed position, including an associated wall 50 or other construction supporting the door frame 18.

The door sections 12, 14 are shown with various panels 52. In these examples, the door section 12 has a height of one panel and the door section 14 has a height of three panels, i.e., the door section 12 is about one third the size of the door section 14. Of course, other ratios are contemplated. The drive system 40 is located on one side of the door frame 18, and drives both the lead screws 22 (on each side of the door frame 18). The left and right lead screws 22 can be connected mechanically to each other through a belt, chain or other mechanical device 42. That is, the forces of the screw drive system 40 are applied on both sides of the door frame 18.

In various exemplary embodiments, the articulated door system 10 can be used for interior doors as well as for exterior doors, i.e., the articulated door system 10 can be used for any type of separation between rooms, exteriors, etc. Note, the door sections 12, 14 can include the panels 52 or any other covering for aesthetics to match the wall 50 or the like.

Figure 6:
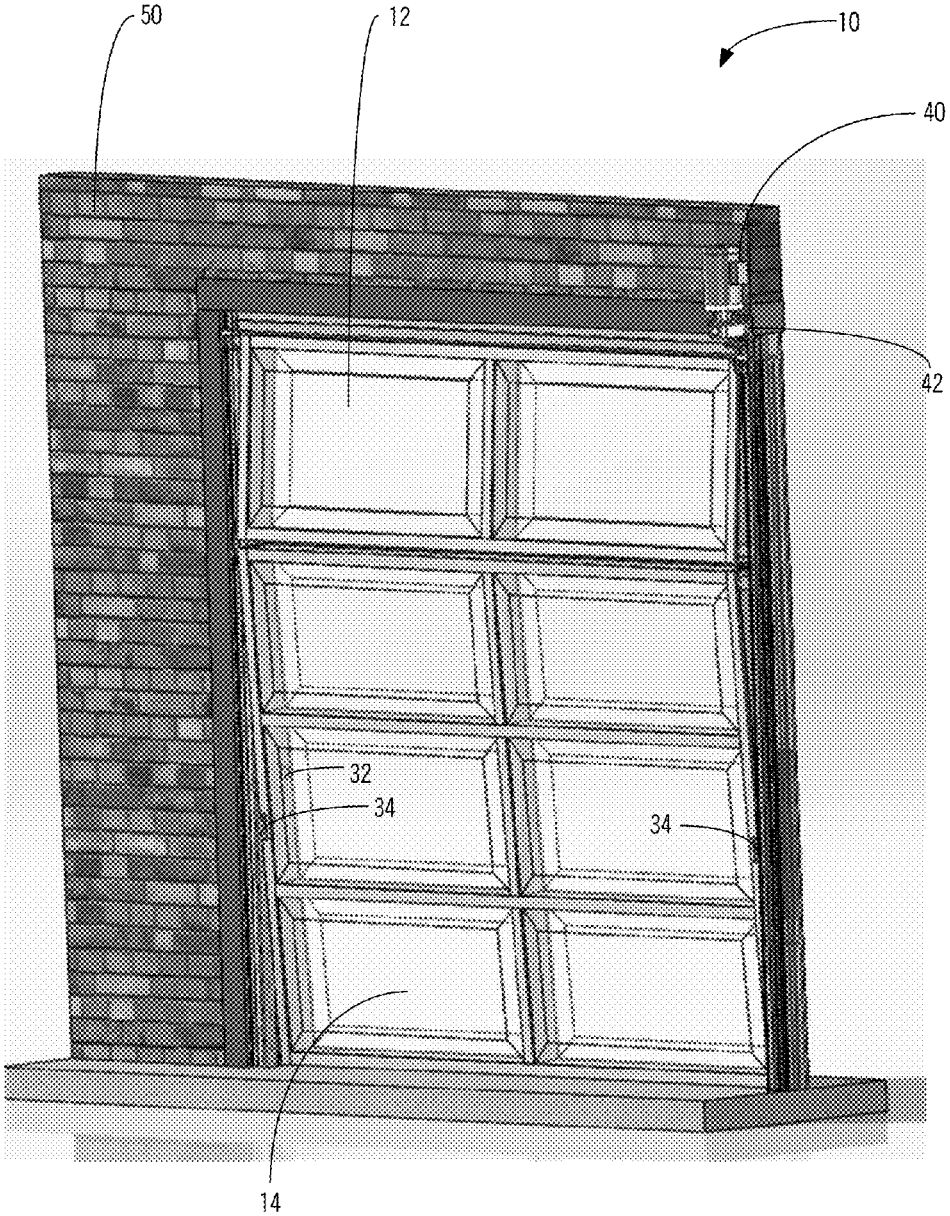
FIG. 6 is a perspective diagram of the initial "Breaking the elbow" motion of the articulated door system where the screw drive system moves the lead screw to cause the door sections to "break" about the hinge.

FIG. 6 illustrates the initial "Breaking the elbow" motion where the screw drive system 40 moves the lead screw 22 to cause the door sections 12, 14 to "break" about the hinge 16. Note, the screw drive system 40 can be operated by a remote control, a wall switch, etc. Various software applications can be used to enhance the operation and function of the articulated door system 10, e.g., mobile device apps to control the drive system 40 to open and close the door sections 12, 14.

Figure 7:
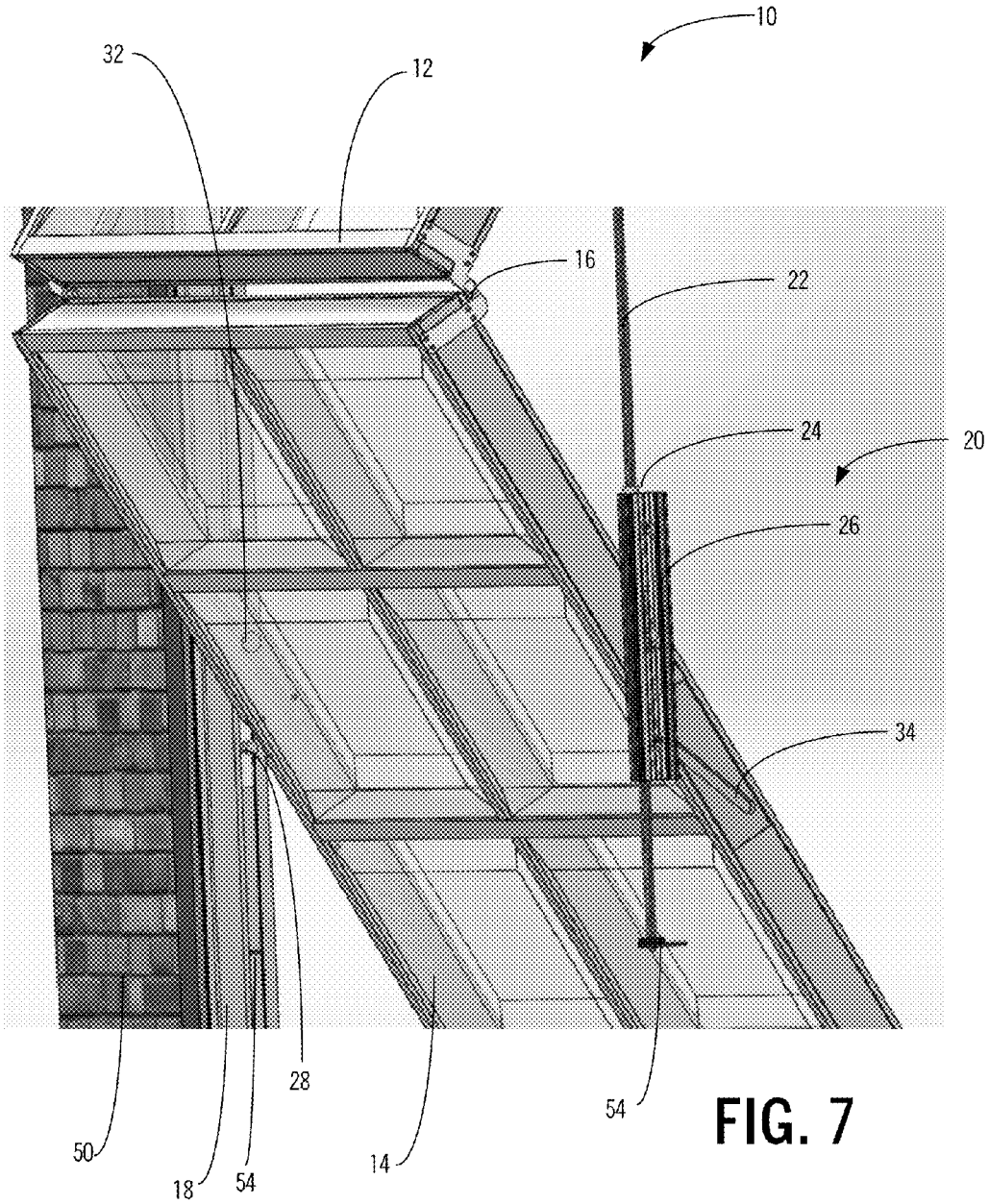
FIG. 7 is a perspective diagram of further articulation of the articulated door system from FIG. 6 with a cut-away view with a right side of the door frame omitted for illustration purposes.

FIG. 7 illustrates further articulation from FIG. 6 of the articulated door system 10 and includes a cut-away view with a right side of the door frame 18 omitted for illustration purposes. Specifically, FIG. 7 shows the lifting block 26 and the cam slot 34 exposed from the right side of the door frame 18. A left side of the door frame 18 is illustrated showing the cam pin 28 leaving the cam slot 34 as the lifting block 26 moves upwards based on the lead screw follower 24 and the screw drive system 40. Also, a foot plate 54 is located at an end of the lead screw 22.

Figure 8:
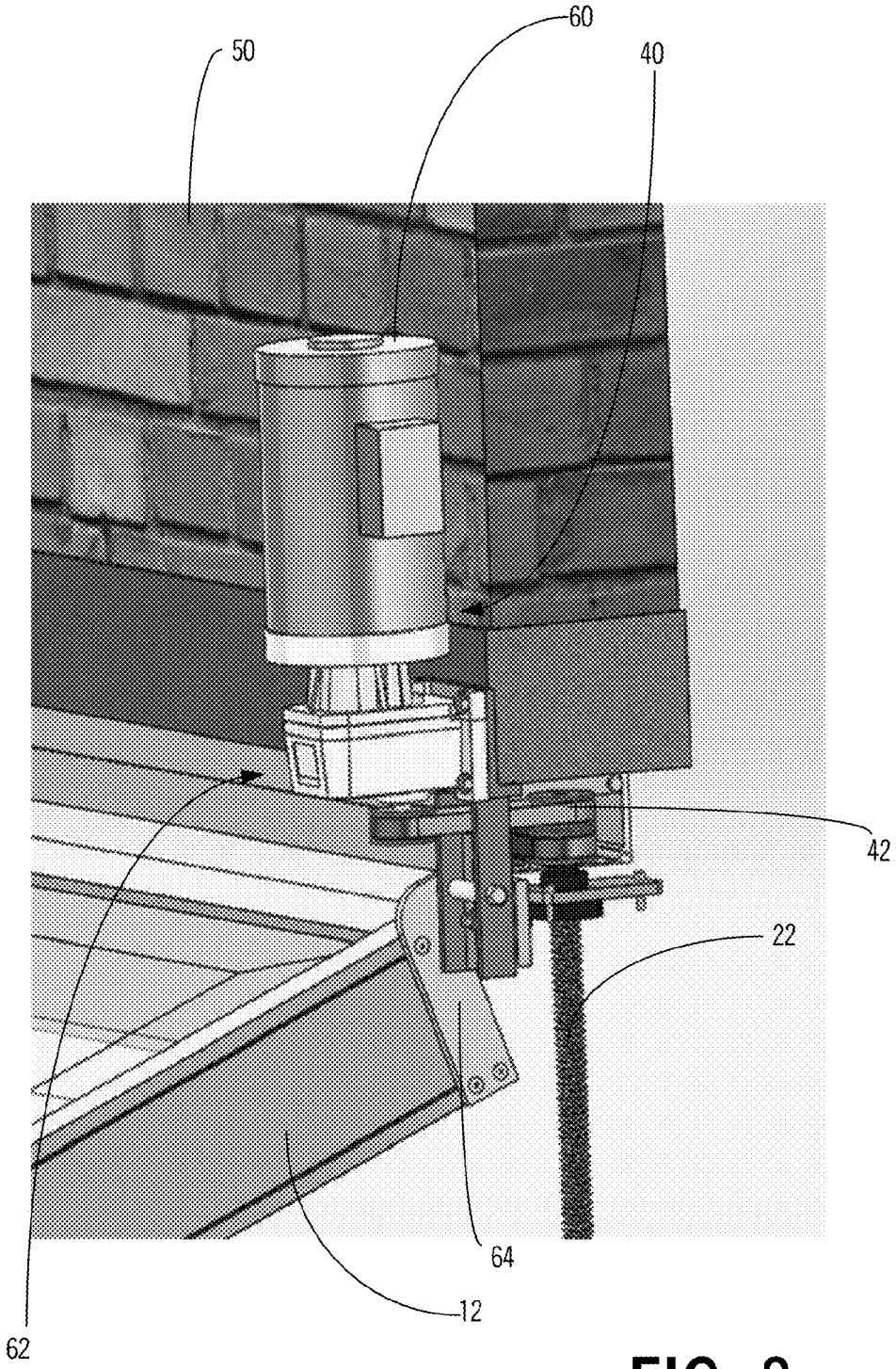
FIG. 8 is a close-up perspective view of the screw drive system for the articulated door system.

FIG. 8 illustrates a close-up perspective view of the screw drive system 40 for the articulated door system 10. The screw drive system 40 includes a motor 60 connected to the lead screw 22 via various gears 62. The motor 60 is configured to rotate clockwise or counterclockwise to cause associated rotation of the lead screw 22. The left and right lead screws 22 are connected mechanically to each other through a belt, chain or other mechanical device. In FIG. 8, the connection between the left and right screws 22 is a drive belt 42, which actuates/drives the left screw 22. In an exemplary embodiment, the motor 60 can be an electric drive motor which is reversible for opening or closing the door sections 12, 14. Also, the door section 12 is coupled to the top door frame 18 via a hinge 64. In an exemplary embodiment, the motor 60 can be selectively disengaged and replaced with a portable power unit such as a cordless drill or a hand operated device that actuates the drive system 40.

Figure 9:
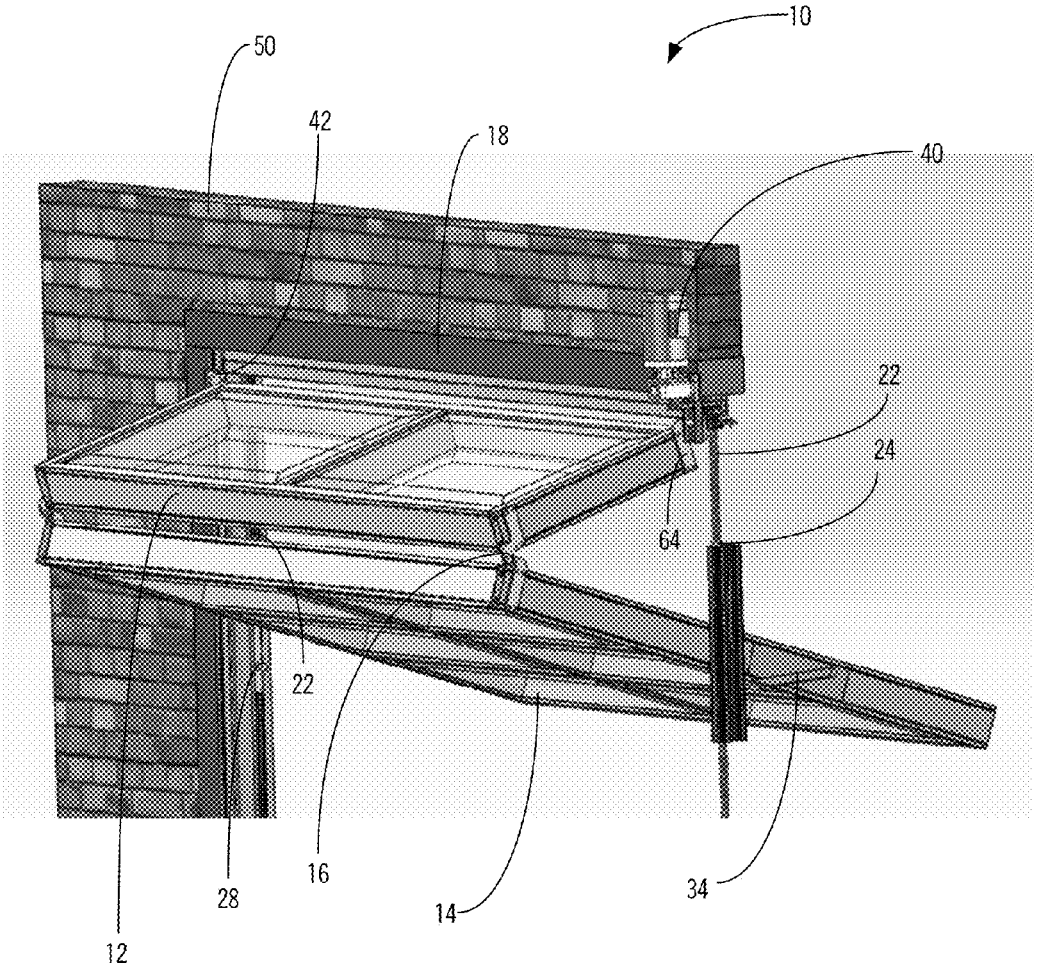
FIG. 9 is a perspective diagram of further articulation from FIG. 8 of the articulated door system with a cut-away view with a right side of the door frame omitted for illustration purposes.

FIG. 9 illustrates further articulation from FIG. 8 of the articulated door system 10 and includes a cut-away view with a right side of the door frame 18 omitted for illustration purposes. Here, the cam pin 28 is fully disengaged from the cam slot 34. The lifting pin 32 is engaged in the lifting pin slot 30 to raise the door section 14.

Figure 10:
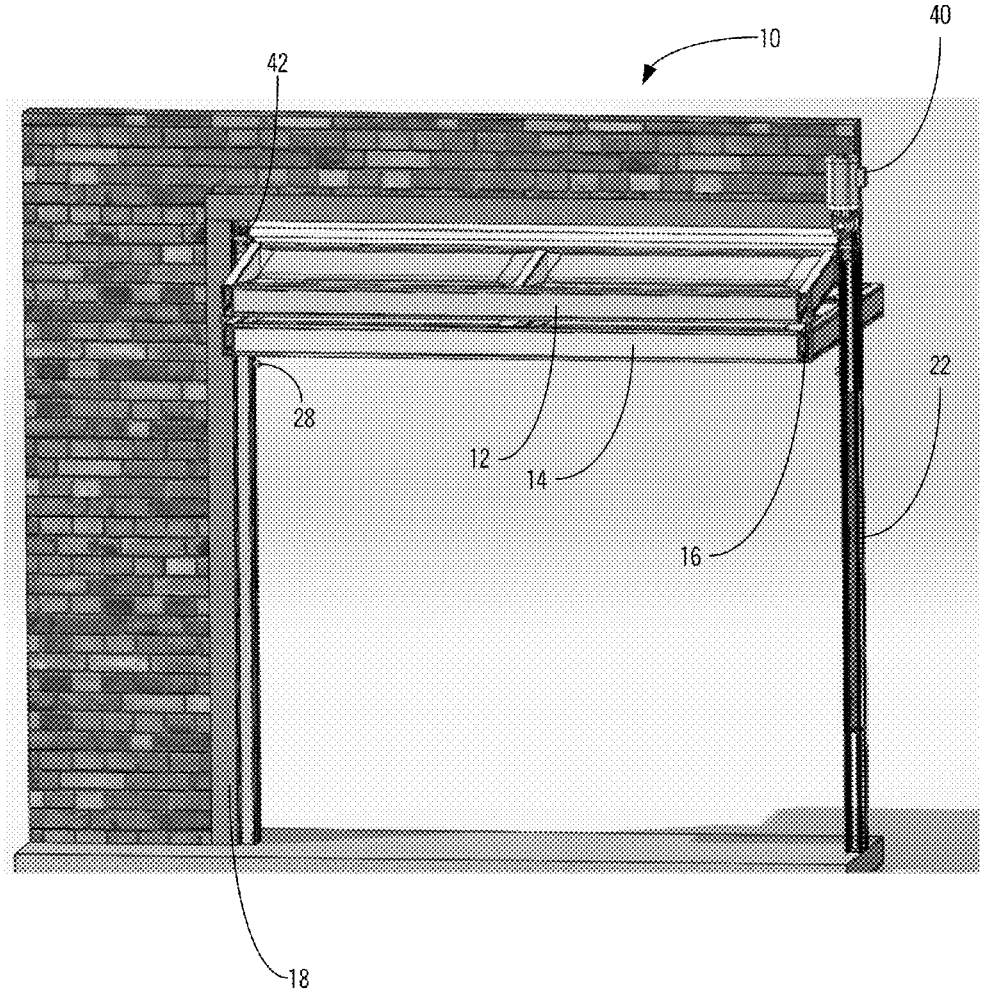
FIG. 10 is a perspective diagram of the articulated door system in an open position from FIG. 9.

FIG. 10 illustrates the articulated door system 10 in an open position from FIG. 9. The door section 14 is substantially parallel to the floor. When in the open position, the door section 14 extends both inside and outside the door frame 18 whereas the door section 12 extends on only one side.

The articulated door system 10 can be a modular platform preconfigured to accept various different door sections 12, 14 with user-adjustable modules like lights, fans, heaters, speakers, etc. The articulated door system 10 is configurable and user-controlled, installed at the factory or optionally added after installation. For the modular platform, the door frame 18 and the lifting block 26 can be aluminum or the like and cut, welded, manufactured, etc. to a specific size and specification for the wall 50 or the like. These components have the channels, i.e., the lifting pin slot 30 and the cam slot 34 to accommodate the drive mechanism 20.

Additionally, the articulated door system 10 can include various additional features, such as electronics added to the door frame 18 (e.g., lighting, heating, cooling fans, laser lights, marquee scroll, LCD glass, LED-embedded glass, speakers, etc.) and non-electronics added to the door sections 12, 14 (e.g., cooling misters, roll-down side curtains, sound baffles, etc.). Also, these various additional features could be added after installation.

Figure 11:
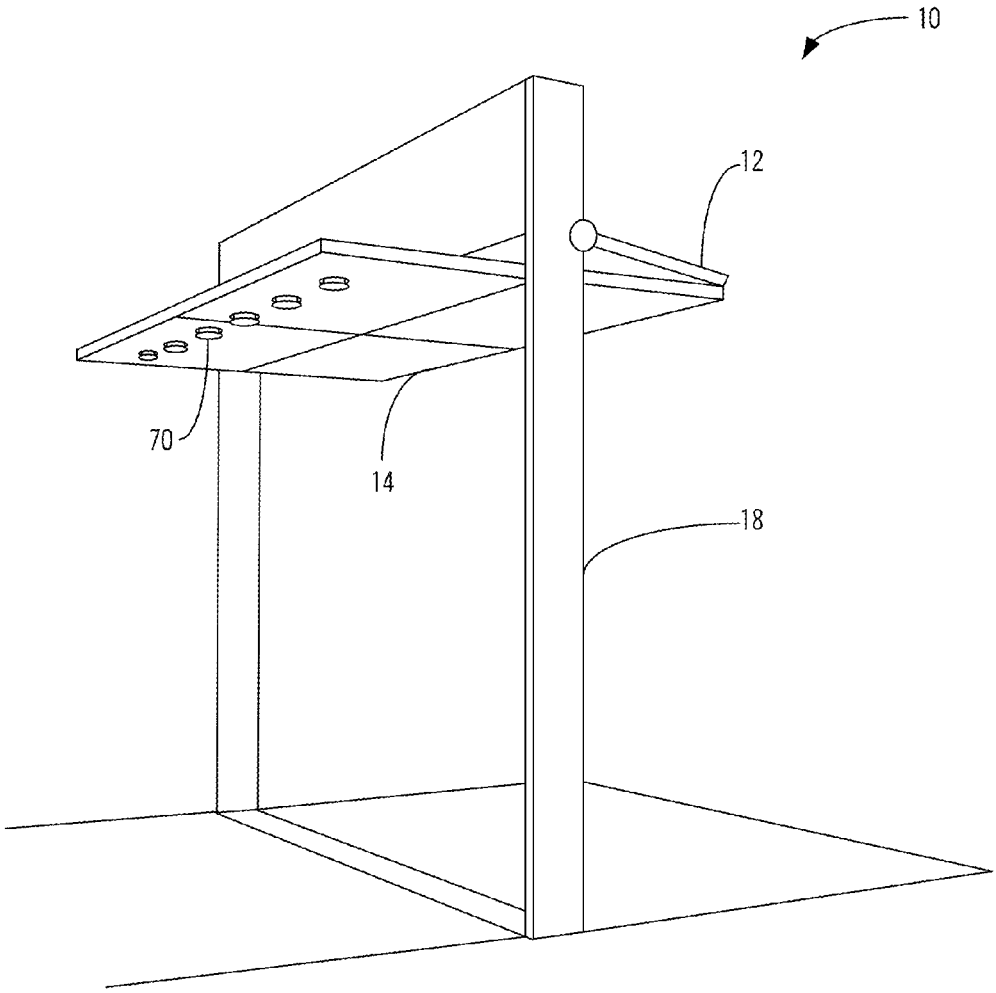
FIG. 11 is a perspective diagram of the articulated door system with add-on modules on a lower door section.

Referring to FIG. 11, in an exemplary embodiment, a perspective diagram illustrates the articulated door system 10 with add-on modules 70 on the door section 14. The add-on modules 70 are located on one side of the door section 14 such that they are directed downwards when the door section 14 is in the open position, i.e., facing downward and substantially parallel to the floor.

In an exemplary embodiment, the add-on modules 70 can be lights, such as light emitting diodes (LEDs) or the like. One benefit of the door sections 12, 14 is the overhead shelter associated with the door section 14 in the open position. The add-on modules 70 can be LED downlights can be installed at the factory, or after installation, in a number of styles and configurations.

In another exemplary embodiment, the add-on modules 70 could be micro-foggers for cooling mist along with centerline LED lights to highlight the fog. For example, micro-foggers embedded in the door section 14 reduce temperatures on hot days for outside restaurants and sidewalk cafes.

In a further exemplary embodiment, the add-on modules 70 could be heaters to provide radiant heat, such as for a sidewalk café or a personal residence.

Figure 12:
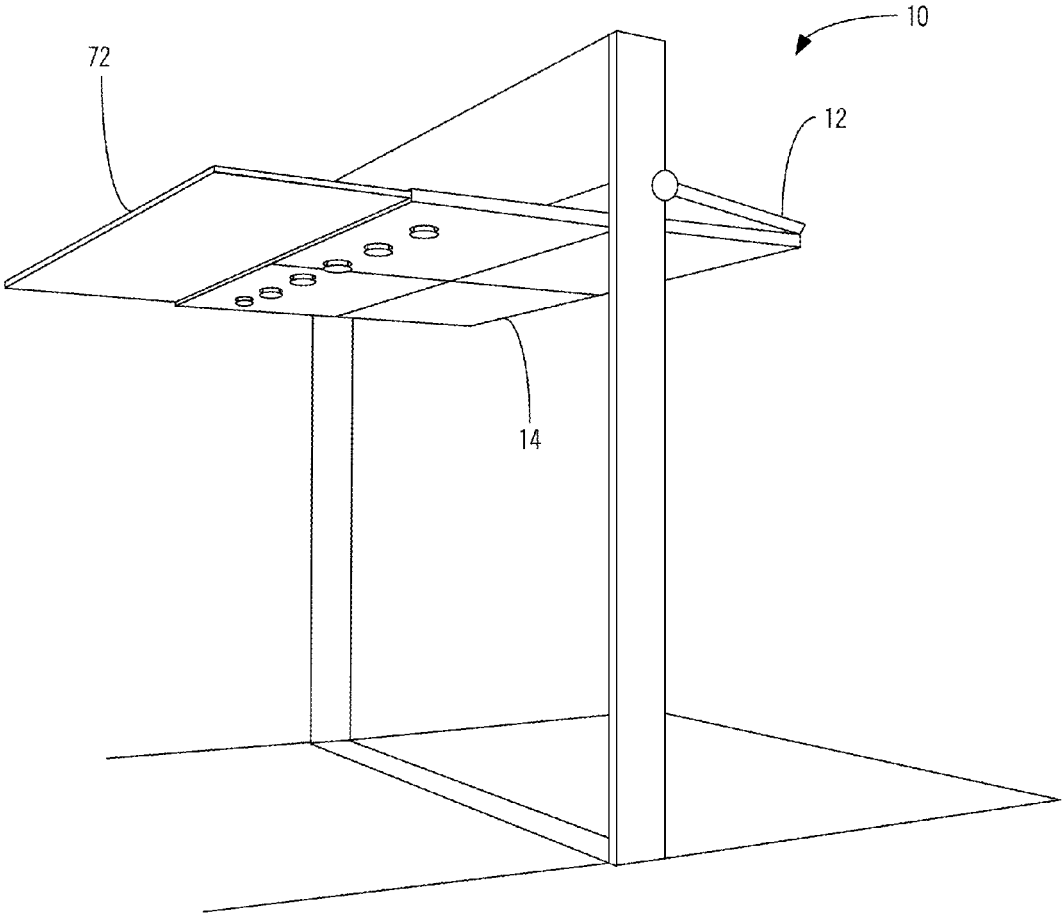
FIG. 12 is a perspective diagram of the articulated door system with an adjustable shade on a lower door section.

Referring to FIG. 12, in an exemplary embodiment, a perspective diagram illustrates the articulated door system 10 with an adjustable shade 72 on the door section 14. The adjustable shade 72 can be a lightweight material or the like that extends or retracts from the door section 14 as needed for additional shade or weather protection for sidewalk cafes or the like. The adjustable shade 72 could track the sun and be automatic or user-controlled. The adjustable shade 72 could be translucent, perforated, printed canvas, etc.

Figure 13:
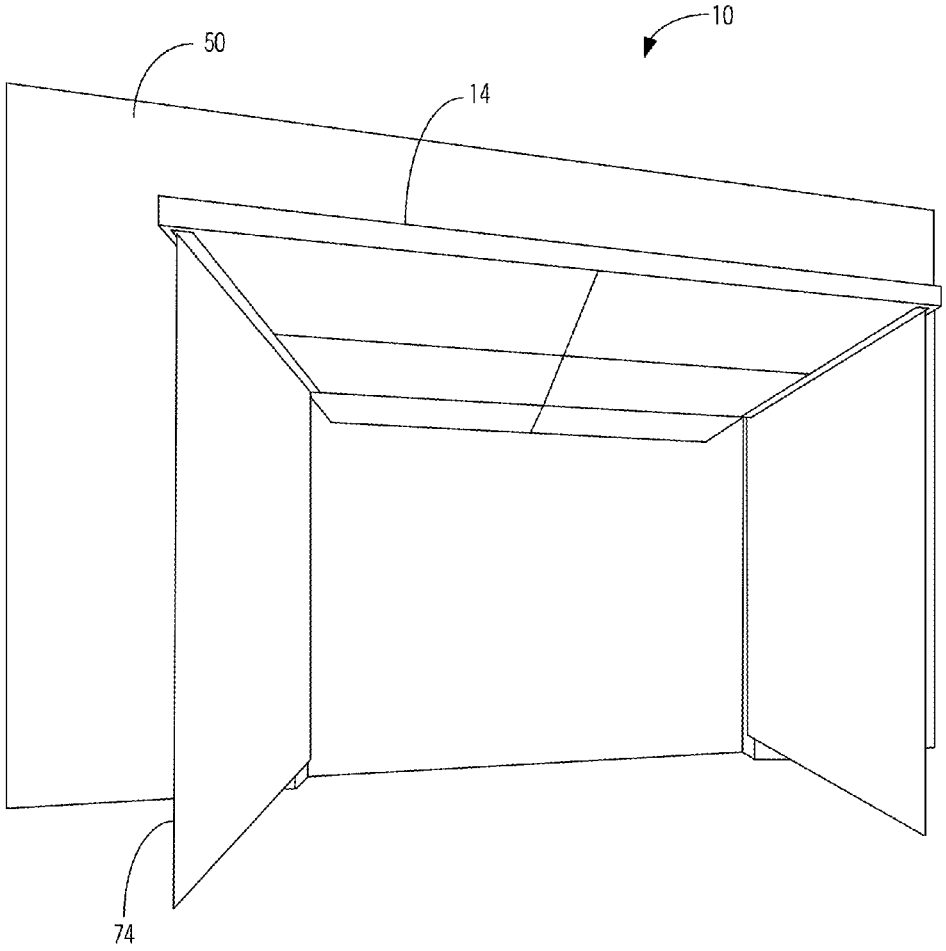
FIG. 13 is a perspective diagram of the articulated door system with side curtains on a lower door section.

Referring to FIG. 13, in an exemplary embodiment, a perspective diagram illustrates the articulated door system 10 with side curtains 74 on the door section 14. Specifically, the side curtains 74 further described the adjustable shade concept from FIG. 12 and can provide additional possibilities for further protection and comfort. The side curtains 74 can be on one or both sides of the door section 14. Additionally, the side curtains 74 can be used in combination with the adjustable shade 72 on the door section 14. The side curtains 74 can be a flexible material that is rolled down to help protect sidewalk café customers from the wind, rain, and cold weather. The flexible material could be translucent, transparent, perforated, or printed.

Figure 14:
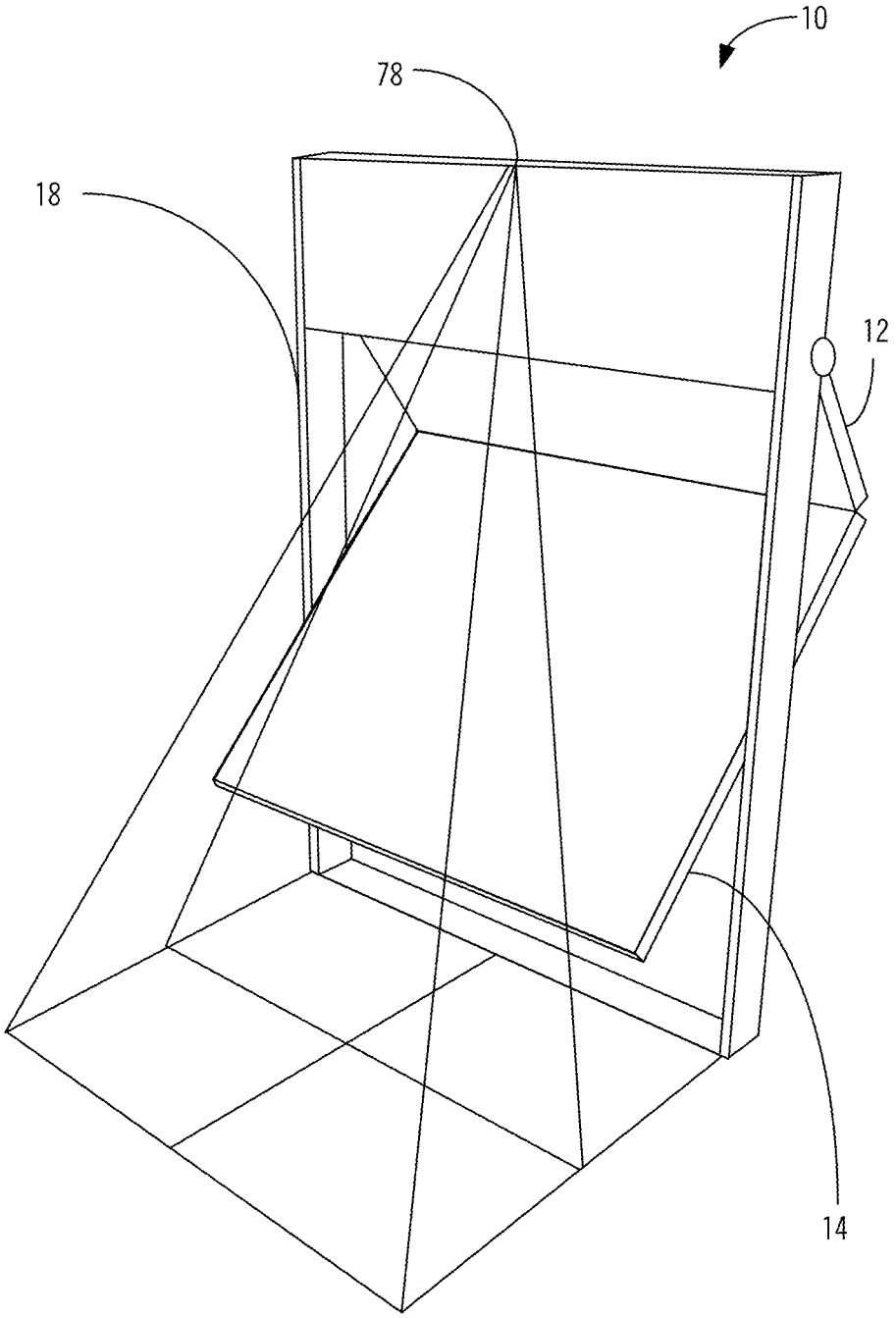
FIG. 14 is a perspective diagram of the articulated door system with a laser scanner.

Referring to FIG. 14, in an exemplary embodiment, a perspective diagram illustrates the articulated door system 10 with a laser scanner 78. Here, the laser scanner 78 is disposed at or above the door frame 18. The laser scanner 78 can be used to "paint" lines and/or a message on the floor/ground near the articulated door system 10.

For example, for sidewalk cafes, opening the door can be a safety hazard and liability. The laser scanner 78 can "paint" a warning sign on the sidewalk while the door sections 12, 14 are in motion for safety or to add drama to the opening ceremony. Once the door sections 12, 14 are open, the laser scanner 78 can be used to provide a message, picture, etc. on the ground/floor. Also, a video screen can be embedded in or attached to one of the door sections 12, 14.

Figure 15:
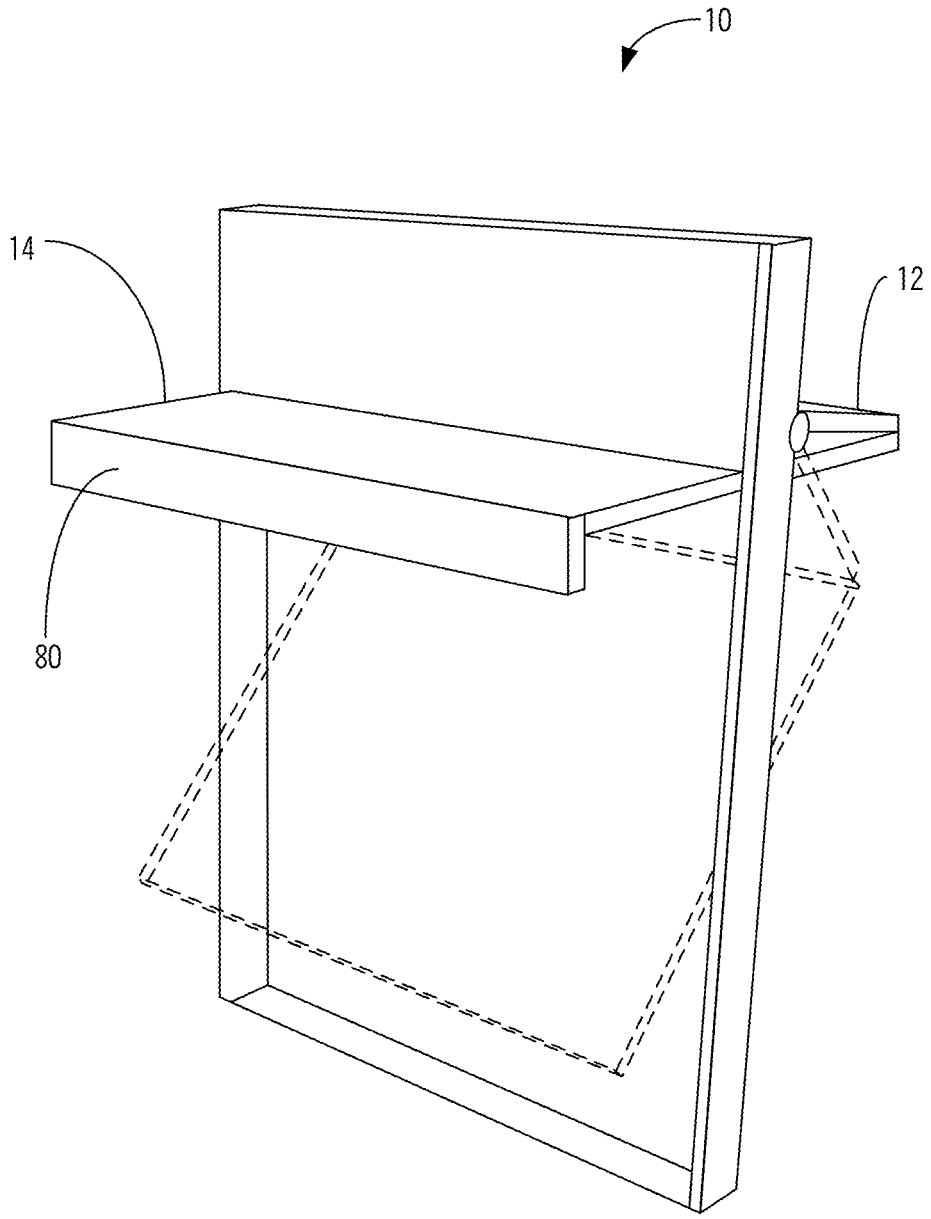
FIG. 15 is a perspective diagram of the articulated door system with a display associated with a lower door section.

Referring to FIG. 15, in an exemplary embodiment, a perspective diagram illustrates the articulated door system 10 with a display 80 associated with the door section 14. The display 80 can be visible when the door sections 12, 14 are open and not visible when closed.

Although the present disclosure has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following claims.

What is claimed is:

1. An articulated door system, comprising:

one or more door sections;

a lifting block associated with a lower door section of the one or more door sections;

a frame supporting the one or more door sections and engaging the lifting block; and a screw system comprising a rotatable screw that is configured to engage the lifting block and lift the lower door section up and down based on rotation of the screw, wherein the lifting block and the frame utilize a pin system between one another to lift the lower door section responsive to the rotation of the screw and the pin system comprises a cam slot comprising an angled slot and associated cam pin engaging the angled slot to start a folding action between the one or more door sections; and a lifting pin engaging a lifting pin slot.

2. The articulated door system of claim 1, wherein the lifting block comprises the cam pin and the lifting pin slot, and wherein the frame comprises the angled slot and the lifting pin.

3. The articulated door system of claim 1, wherein, responsive to the rotation of the screw, the cam pin follows the angled slot and subsequently the lifting pin engages the lifting pin slot.

4. The articulated door system of claim 1, wherein, responsive to the rotation of the screw, the lifting pin slot operates precisely with the cam slot and the cam pin such that once the cam pin disengages from the cam slot, the lifting pin has reached the bottom of the lifting pin slot and the lower door section is in a position that the lifting pin lifts the lower door section.

5. The articulated door system of claim 1, wherein, responsive to the rotation of the screw, the lifting block moves within an ovular space comprising the lifting pin slot until the lifting pin hits a bottom of the lifting block thereby engaging the lifting pin to start lifting the lower door section.

6. The articulated door system of claim 1, wherein the screw has a pitch such that if the lead screw drive should fail in any way, the lower door section is held and kept in position.

7. The articulated door system of claim 1, wherein the screw system comprises a screw follower precision machined to match the screw and move precisely up or down when the screw rotates to move the lifting block.

8. The articulated door system of claim 1, wherein the articulated door system does not utilize springs, strap lifting systems, or counterweights.

9. An articulated door method, comprising:

providing one or more door sections;

providing a lifting block associated with a lower door section of the one or more door sections;

providing a frame supporting the one or more door sections and engaging the lifting block; and providing a screw system comprising a rotatable screw that is configured to engage the lifting block and lift the lower door section up and down based on rotation of the screw, wherein the lifting block and the frame utilize a pin system between one another to lift the lower door section responsive to the rotation of the screw and the pin system comprises a cam slot comprising an angled slot and associated cam pin engaging the angled slot to start a folding action between the one or more door sections; and a lifting pin engaging a lifting pin slot.

10. The articulated door method of claim 9, wherein the lifting block comprises the cam pin and the lifting pin slot, and wherein the frame comprises the angled slot and the lifting pin.

11. The articulated door method of claim 9, wherein, responsive to the rotation of the screw, the cam pin follows the angled slot and subsequently the lifting pin engages the lifting pin slot.

12. The articulated door method of claim 9, wherein, responsive to the rotation of the screw, the lifting pin slot operates precisely with the cam slot and the cam pin such that once the cam pin disengages from the cam slot, the lifting pin has reached the bottom of the lifting pin slot and the lower door section is in a position that the lifting pin lifts the lower door section.

13. The articulated door method of claim 9, wherein, responsive to the rotation of the screw, the lifting block moves within an ovular space comprising the lifting pin slot until the lifting pin hits a bottom of the lifting block thereby engaging the lifting pin to start lifting the lower door section.

14. The articulated door method of claim 9, wherein the screw has a pitch such that if the screw drive should fail in any way, the lower door section is held and kept in position.

15. The articulated door method of claim 9, wherein the screw system comprises a screw follower precision machined to match the screw and move precisely up or down when the screw rotates to move the lifting block, and wherein the articulated door system does not utilize springs, strap lifting systems, or counterweights.

16. A bi-fold articulated door system, comprising:

a first door section and a second door section;

a lifting block associated with the second door section;

a frame supporting the first door section and the second door section and engaging the lifting block; and a screw system comprising a rotatable screw that is configured to engage the lifting block and lift the second door section up and down based on rotation of the screw, wherein the lifting block and the frame utilize a pin system between one another to lift the second door section responsive to the rotation of the screw and the pin system comprises a cam slot comprising an angled slot and associated cam pin engaging the angled slot to start a folding action between the first door section and the second door section; and a lifting pin engaging a lifting pin slot.

17. The bi-fold articulated door system of claim 16, wherein the lifting block comprises the cam pin and the lifting pin slot, and wherein the frame comprises the angled slot and the lifting pin.

18. The bi-fold articulated door system of claim 16, wherein, responsive to the rotation of the screw, the cam pin follows the angled slot and subsequently the lifting pin engages the lifting pin slot.

19. The bi-fold articulated door system of claim 16, wherein, responsive to the rotation of the screw, the lifting pin slot operates precisely with the cam slot and the cam pin such that once the cam pin disengages from the cam slot, the lifting pin has reached the bottom of the lifting pin slot and the second door section is in a position that the lifting pin lifts the second door section.

20. The bi-fold articulated door system of claim 16, wherein, responsive to the rotation of the screw, the lifting block moves within an ovular space comprising the lifting pin slot until the lifting pin hits a bottom of the lifting block thereby engaging the lifting pin to start lifting the second door section.

* * * * *